US008454324B2

(12) United States Patent
Grapes

(10) Patent No.: US 8,454,324 B2
(45) Date of Patent: Jun. 4, 2013

(54) PUMP

(75) Inventor: Robert Donald Grapes, Palmerston North (NZ)

(73) Assignee: Precision Dispensing Systems Limited, Palmerston North (NZ)

( * ) Notice: Subject to any disclaimer, the term of this patent is extended or adjusted under 35 U.S.C. 154(b) by 543 days.

(21) Appl. No.: 12/582,665

(22) Filed: Oct. 20, 2009

(65) Prior Publication Data

US 2010/0104458 A1 Apr. 29, 2010

Related U.S. Application Data

(63) Continuation-in-part of application No. 10/593,174, filed as application No. PCT/NZ2005/000046 on Mar. 18, 2005, now abandoned.

(30) Foreign Application Priority Data

Mar. 18, 2004 (NZ) ..... 531822

(51) Int. Cl.
*F04B 43/06* (2006.01)
*F01B 19/00* (2006.01)

(52) U.S. Cl.
USPC ..... 417/395; 92/96

(58) Field of Classification Search
USPC ..... 417/395, 394, 490; 92/89–96, 98, 92/177; 29/888.02, 446
See application file for complete search history.

(56) References Cited

U.S. PATENT DOCUMENTS

| | | | | | |
|---|---|---|---|---|---|
| 2,762,395 | A | * | 9/1956 | Lamb | 92/90 |
| 2,821,930 | A | | 2/1958 | Smith | 417/317 |
| 2,902,936 | A | | 9/1959 | Bradley | |
| 3,000,320 | A | * | 9/1961 | Ring | 417/383 |
| 3,006,306 | A | * | 10/1961 | Hartz et al. | 72/54 |
| 3,093,086 | A | * | 6/1963 | Altoz et al. | 92/102 |
| 3,094,074 | A | * | 6/1963 | Tuckey | 417/395 |
| 3,101,058 | A | | 8/1963 | Carr, Jr. et al. | |
| 3,124,078 | A | * | 3/1964 | Hardy | 417/395 |
| 3,294,031 | A | | 12/1966 | Latawic | 417/375 |
| 3,314,371 | A | | 4/1967 | Hopkinson | |

(Continued)

FOREIGN PATENT DOCUMENTS

| | | |
|---|---|---|
| EP | 0 314 379 B1 | 8/1991 |
| FR | 787226 | 9/1935 |
| WO | WO-99/01687 | 1/1999 |
| WO | WO-02/18790 | 3/2002 |

OTHER PUBLICATIONS

Non-Final Office Action dated Jun. 4, 2008, U.S. Appl. No. 10/593,174, filed Sep. 15, 2006, 14 pgs.

(Continued)

*Primary Examiner* — Devon Kramer
*Assistant Examiner* — Alexander Comley
(74) *Attorney, Agent, or Firm* — Blakely Sokoloff Taylor & Zafman, LLP

(57) ABSTRACT

A pump that has a cavity (13) in which is located a non-elastomeric membrane (14). An inlet (24) opens into the cavity (13) and is associated with a valve (27). A valve (28) is likewise provided in an outlet (25). Also opening into cavity (13) is a port (22) to which a negative or positive pressures can be applied whereby the membrane (14) can be moved between its two stable states corresponding to completion of inlet and exhaust of a pumping cycle.

23 Claims, 5 Drawing Sheets

U.S. PATENT DOCUMENTS

| | | | | | |
|---|---|---|---|---|---|
| 3,338,171 | A | * | 8/1967 | Conklin et al. | 417/339 |
| 3,357,360 | A | | 12/1967 | Borell et al. | |
| 3,431,823 | A | | 3/1969 | Orlita | |
| 3,460,482 | A | | 8/1969 | Jackson et al. | |
| 3,485,258 | A | | 12/1969 | Greene | |
| 3,503,307 | A | | 3/1970 | Kazimierz | 92/98 R |
| 3,689,719 | A | | 9/1972 | Phillips et al. | |
| 3,900,276 | A | | 8/1975 | Dilworth | 417/542 |
| 3,947,156 | A | | 3/1976 | Becker | 417/437 |
| 3,955,901 | A | * | 5/1976 | Hamilton | 417/395 |
| 4,021,164 | A | | 5/1977 | Tell | |
| 4,090,964 | A | * | 5/1978 | Bakken et al. | 210/134 |
| 4,124,008 | A | | 11/1978 | Fujikawa | 123/495 |
| 4,181,245 | A | * | 1/1980 | Garrett et al. | 222/450 |
| 4,261,356 | A | | 4/1981 | Turner et al. | |
| 4,304,260 | A | | 12/1981 | Turner et al. | |
| 4,430,048 | A | | 2/1984 | Fritsch | |
| 4,437,823 | A | | 3/1984 | Tigane | 418/219 |
| 4,486,190 | A | * | 12/1984 | Reinicke | 604/67 |
| 4,492,013 | A | * | 1/1985 | Porel | 29/890.06 |
| 4,573,885 | A | | 3/1986 | Petersen | 417/383 |
| 4,627,256 | A | | 12/1986 | Myer | 72/60 |
| 4,634,430 | A | * | 1/1987 | Polaschegg | 604/141 |
| 4,718,893 | A | * | 1/1988 | Dorman et al. | 604/67 |
| 4,755,111 | A | * | 7/1988 | Cocchi et al. | 417/394 |
| 4,863,066 | A | | 9/1989 | Uffenheimer et al. | |
| 4,904,167 | A | * | 2/1990 | Eickmann | 417/395 |
| 4,915,017 | A | * | 4/1990 | Perlov | 92/5 R |
| 4,936,758 | A | * | 6/1990 | Coble | 417/413.1 |
| 4,995,864 | A | * | 2/1991 | Bartholomew et al. | 604/153 |
| 5,002,471 | A | | 3/1991 | Perlov | 417/413.1 |
| 5,018,949 | A | * | 5/1991 | Gotz | 417/339 |
| 5,088,515 | A | * | 2/1992 | Kamen | 137/15.17 |
| 5,165,869 | A | * | 11/1992 | Reynolds | 417/385 |
| 5,244,360 | A | * | 9/1993 | Lefebvre | 417/383 |
| 5,367,878 | A | * | 11/1994 | Muntz et al. | 60/512 |
| 5,423,738 | A | | 6/1995 | Robinson et al. | 604/6.01 |
| 5,458,468 | A | * | 10/1995 | Ye et al. | 417/395 |
| 5,499,909 | A | * | 3/1996 | Yamada et al. | 417/384 |
| 5,669,764 | A | * | 9/1997 | Behringer et al. | 417/395 |
| 5,836,750 | A | | 11/1998 | Cabuz | |
| 5,902,096 | A | * | 5/1999 | Behringer et al. | 417/395 |
| 6,105,829 | A | * | 8/2000 | Snodgrass et al. | 222/214 |
| 6,132,187 | A | * | 10/2000 | Ericson | 417/486 |
| 6,190,565 | B1 | * | 2/2001 | Bailey et al. | 210/744 |
| 6,251,293 | B1 | | 6/2001 | Snodgrass et al. | |
| 6,273,687 | B1 | * | 8/2001 | Nogimori et al. | 417/413.1 |
| 6,464,474 | B2 | * | 10/2002 | Schluecker | 417/383 |
| 6,474,961 | B1 | * | 11/2002 | Timmer et al. | 417/393 |
| 6,484,383 | B1 | * | 11/2002 | Herklotz | 29/446 |
| 6,554,589 | B2 | * | 4/2003 | Grapes | 417/477.12 |
| 6,582,206 | B2 | * | 6/2003 | Schluecker | 417/395 |
| 6,669,455 | B2 | | 12/2003 | Welch | |
| 6,705,841 | B2 | * | 3/2004 | Pawelski et al. | 417/222.1 |
| 6,749,403 | B2 | * | 6/2004 | Bryant et al. | 417/53 |
| 6,887,047 | B2 | * | 5/2005 | Grapes | 417/384 |
| 6,971,859 | B2 | * | 12/2005 | Yamamoto et al. | 417/395 |
| 7,284,966 | B2 | | 10/2007 | Xu et al. | |
| 7,942,647 | B2 | | 5/2011 | Okumura et al. | |
| 1,005,270 | A1 | | 10/2011 | Milburn | |
| 2002/0047099 | A1 | * | 4/2002 | Grapes | 251/7 |
| 2003/0194332 | A1 | * | 10/2003 | Jahn et al. | 417/395 |
| 2004/0009081 | A1 | * | 1/2004 | Grapes | 417/478 |
| 2004/0109769 | A1 | * | 6/2004 | Jahn et al. | 417/395 |
| 2005/0074340 | A1 | * | 4/2005 | Xu et al. | 417/395 |

OTHER PUBLICATIONS

Final Office Action dated Nov. 14, 2008, U.S. Appl. No. 10/593,174, filed Sep. 15, 2006, 10 pgs.

Non-Final Office Action dated May 1, 2009, U.S. Appl. No. 10/593,174, filed Sep. 15, 2006, 12 pgs.

Final Office Action dated Dec. 24, 2009, U.S. Appl. No. 10/593,174, filed Sep. 15, 2006, 14 pgs.

Precision Dispensing Systems Ltd, *European Search Report* mailed Apr. 18, 2012; EP Appln No. 05722117.8.

* cited by examiner

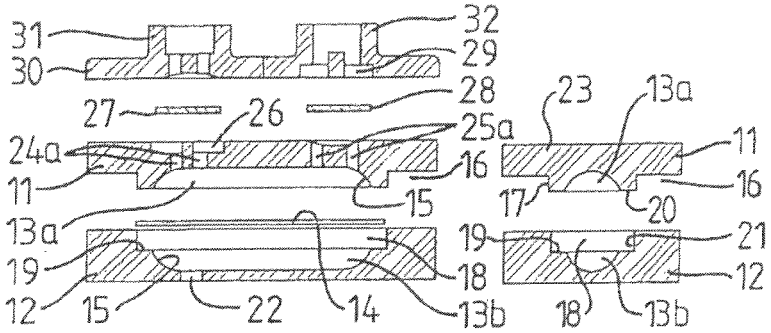
FIG. 2
FIG. 3
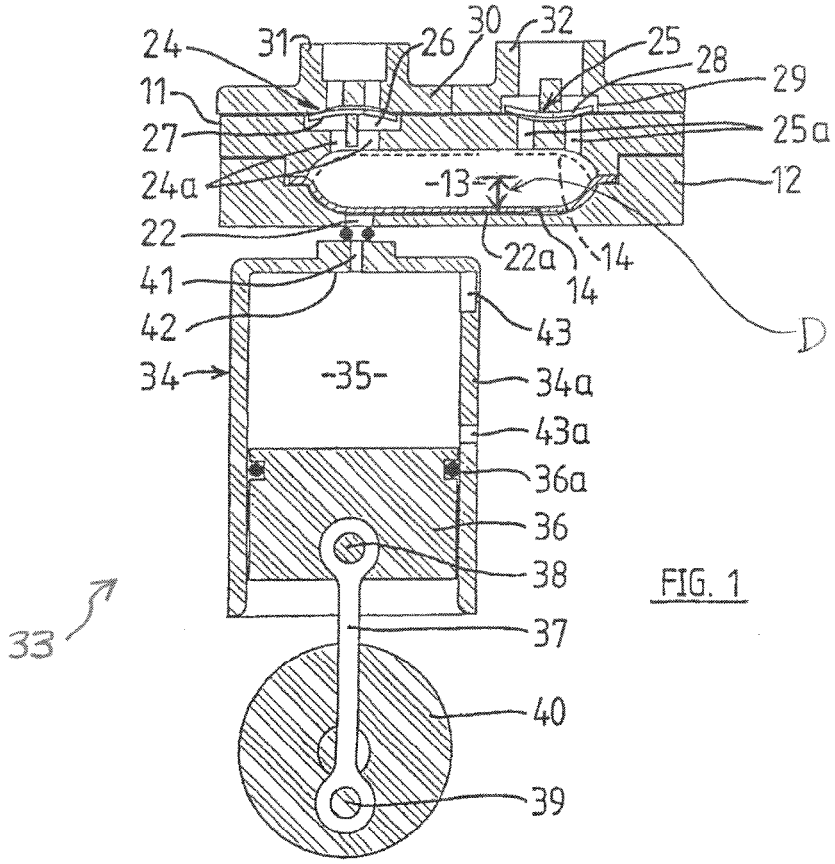
FIG. 1

PUMP

The present patent application is a Continuation-in-Part of application Ser. No. 10/593,174, filed Sep. 15, 2006, which application is a national stage of International Application No. PCT/NZ2005/000046, filed Mar. 18, 2005.

BACKGROUND TO THE INVENTION

This invention relates to a pump. More particularly the present invention relates to a membrane pump.

Pumps, which incorporate a flexible element to achieve the pumping action, are known. For example, the flexible element can be in the form of a deformable tube or membrane. A deformable tube pump is described in our international patent specifications WO 99/01687 and WO 02/18790.

A membrane pump is disclosed in our PCT specification, WO 2005/088128. That pump uses an elastomeric membrane which is clamped between two pump halves. The membrane has outer dimensions greater than the size of the recess in which it is located, such that compressive forces are created in the elastomeric membrane. This pump provides an improved membrane life over prior pumps. However, the Applicant has found that still further improvements are possible in membrane pumps in order to improve the membrane life, accuracy and other operating parameters of the pump.

SUMMARY OF THE INVENTION

It is an object of the present invention to provide an improved membrane pump.

It is a further object of the invention to provide a membrane pump with a long membrane life.

It is a further object of the invention to provide a membrane pump with a reliable and accurate pump volume, and which remains accurate over a long life time.

It is a further object of the invention to provide improved efficiency over prior membrane pumps.

It is a further object of the present invention to provide improved methods of manufacturing membranes and membrane pumps.

Broadly according to a first aspect the invention provides a membrane pump including:

an elongate cavity with opposing surfaces and having a ratio of width to depth in the range 8:1 to 16:1, where the depth is measured from one opposing surface to a mid-point of the cavity;

inlet and outlet passages communicating with the cavity;

a pressure port connected to the cavity; and a pre-deformed non-elastomeric membrane located within the cavity;

wherein the pre-deformed non-elastomeric membrane:

has a first stable state in contact with one of the opposing surfaces, the first stable state corresponding to completion of an inlet stage of a pumping cycle;

has a second stable state in contact with the other opposing surface, the second stable state corresponding to completion of an exhaust stage of a pumping cycle; and can be caused to invert from one stable state to the other stable state by application of positive or negative pressure to the cavity via the pressure port.

Preferably the ratio of width to depth is in the range 10:1 to 14:1.

Preferably the ratio of width to depth is around 12:1.

Preferably the non-elastomeric membrane is formed of a non-elastomeric sheet material.

Preferably the non-elastomeric membrane is resistant to corrosion by chemicals.

Preferably the non-elastomeric membrane is formed from a non-elastomeric fluoropolymer.

Preferably the non-elastomeric membrane is formed from one of: polytetrafluoroethylene, perfluoroalkoxy polymer resin or fluorinated ethylenepropylene.

Preferably the non-elastomeric membrane is has a thickness in the range 0.002 to 0.025 inches. Preferably the thickness is in the range 0.005 to 0.020 inches. Preferably the thickness is in the range 0.010 to 0.015 inches Preferably the depth is less than 5 mm. Preferably the depth is less than 3 mm. Preferably the depth is in the range 1 to 3 mm.

Preferably the pressure port is situated adjacent one end of the cavity.

Preferably the outlet passage is situated adjacent the same end of the cavity as the pressure port.

Preferably the membrane is clamped between first and second housing sections, each section having a cavity section such that when the housing sections are assembled to form a housing, said cavity is formed.

Preferably each opposing surface has continuous curvature.

In a second aspect the invention provides a method of manufacturing a membrane pump, including:

providing a first pump housing section and a second pump housing section, the first and second pump housing sections being shaped to form, when joined, a cavity with opposing surfaces;

positioning a non-elastomeric sheet material membrane between the first and second pump housing sections;

joining the first and second pump housing sections such that the non-elastomeric membrane extends through the cavity; and permanently deforming the non-elastomeric membrane by applying a pressure to the cavity, thereby forcing the non-elastomeric membrane to conform to one of the opposing surfaces.

In a third aspect the invention provides a method of forming a membrane pump membrane, including:

arranging a non-elastomeric material adjacent a concave surface;

securing the non-elastomeric material at two or more peripheral points; and permanently deforming the non-elastomeric material by forcing it against the concave surface, such that the permanently deformed non-elastomeric material will conform to a pump surface.

BRIEF DESCRIPTION OF THE DRAWINGS

In the following more detailed description of the invention according to one preferred embodiment, reference will be made to the accompanying drawings in which:

FIG. 1 is a longitudinal cross-section through the pump,

FIG. 2 is an exploded view in cross-section of the pump as shown in FIG. 1, FIG. 3 is a transverse cross-sectional view taken between the inlet and outlet ports but showing only two sections of the pump body.

DETAILS DESCRIPTION OF PREFERRED EMBODIMENTS OF THE INVENTION

Referring firstly to FIGS. 1-3, the pump 10 is, according to a preferred embodiment, formed of two housing sections 11 and 12. When these are assembled together they define an internal pump cavity 13. Clamped between the housing sections 11 and 12, as will hereinafter be described, is a membrane 14 which is made from a suitable flexible material.

While prior membrane pumps have used flexible elastomeric materials, the Applicant has surprisingly found that the use of a flexible non-elastomeric material in a pump cavity designed specifically for reduced membrane stress provides much improved membrane life.

Figure 4:
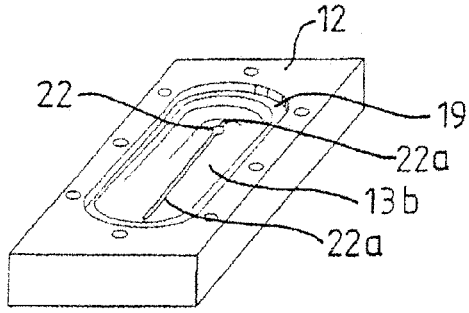
FIG. 4 is a perspective view of one housing section of the pump.

In the preferred form of the invention, the cavity 13 is elongate and, as shown in FIG. 4, each end 15 is complex curved. In cross-section as shown in FIG. 1, each end is also curved as indicated at 15. Furthermore, in transverse cross-section as shown in FIG. 3, the cavity 13 is also of curved cross-section. The cavity curves gently towards its perimeter, in order to reduce the stresses on the membrane during use. The membrane therefore encounters a gentle continuous curved surface as it comes into contact with the cavity wall, rather than a sharp bend which would create stress in the membrane.

The Applicant's pump may use a small pump volume, defined by the volume of the cavity 13. One cycle of the membrane pumps this volume of fluid from an inflow port to an outflow port, as will become clear below. Preferably the pump volume is less than 20 ml, more preferably less than 10 ml, ideally around 0.5 to 5 ml. Preferably the pump volume is in the range 0.5 to 20 ml, more preferably 0.5 to 10 ml, ideally around 0.5 to 5 ml. This low pump volume contributes both to the accuracy of the pump and the long life of the membrane.

The cavity 13 preferably has a small depth. This means that there is a large surface area of the membrane relative to the pump volume. The cavity depth, measured from one side of the cavity to the half way point of the cavity (this depth is marked "D" in FIG. 1), may be less than 5 mm, preferably less than 3 mm, ideally around 1 to 3 mm. Again, this small depth contributes both to the accuracy of the pump and the long life of the membrane.

The cavity is preferably elongate. The cavity may have a length in the range 40 to 100 mm, preferably around 40 to 70 mm. The cavity may have a width in the range 10 to 40 mm, preferably 10 to 20 mm.

The pump volume and/or cavity dimensions result in only a small amount of movement of the membrane from one side of the cavity to the other. This reduces stress on the membrane and therefore contributes to long life of the membrane.

Preferably the ratio of width of the cavity to depth (as defined above) of the cavity is preferably in the range 8:1 to 16:1, more preferably 10:1 to 14:1, ideally around 12:1. The Applicant has found that these ratios, with appropriate shaping of the chamber walls, determine an arc which significantly reduces the stress on the membrane, leading to long membrane life. Lower ratios place excess stress on the membrane, while higher ratios interfere with the efficient working of the bi-stable membrane.

Housing section 11 incorporates a rebate 16, which effectively results in an upstand or projecting portion 17. Thus, the cavity section 13*a* is effectively located, at least in part, in the resultant upstanding portion 17.

The other housing section 12 has a recessed portion 18 with cavity section 13*b* extending away from the floor of the recess 18. Thus, when the two housing sections 11 and 12 are brought together the projecting portion 17 engages snugly within recess 18. However, the arrangement is such that surface 20 of projecting portion 17, terminates a distance from the floor 19 of recess 18. In the preferred form of the invention, this distance D (see FIG. 1) is less than the thickness of the membrane 14. The reason for this gap D will hereinafter become apparent.

The membrane 14 is, in the preferred form of the invention, cut from sheet material. The material is of a type which is compatible with the fluid that is intended to be pumped through the pump 10. For example, if the fluid to be pumped through the pump 10 is corrosive, then the membrane material is selected such as to be able to withstand the corrosive nature of the fluid. By way of further example, the membrane is selected from a food grade material in the event that the pump is to handle a liquid foodstuff.

The various types of materials and applications to which a pump of this type can be put are well known to those skilled in the art. Therefore further description herein is not necessary for the purposes of describing the construction and operation of the pump according to the invention.

According to the invention, the membrane 14 is cut in a shape and to a size, which enables it to be snugly fitted into the recess 18.

When the housing section 11 is combined with housing section 12 (the membrane 14 being in place in recess 18) the fact that distance D is less than the thickness of the membrane 14 causes the peripheral edge margin portion of the membrane 14 to be sandwiched and securely clamped between opposing surfaces 19 and 20. This clamping force provides a secure seal between the two sides of the membrane, preventing fluid from flowing between the two sides. One or more sealing elements, such as O-rings, may be provided to assist with this seal.

A port 22 is formed in the housing section 12 and opens into the cavity section 13*b*. This port 22 can be offset toward one end of the cavity 13, as shown in the drawings, or else it can be located midway in the length of the cavity 13.

In one form of the invention, a recessed flow path in the form of a narrow groove 22*a* can be formed in the wall surface of the cavity section 13*b* and extend along the length of the cavity 13 either side of from the port 22. Also a similar recessed flow path in the form of a narrow groove (not shown) can be formed in cavity 13*b*. The effect of the recessed flow path is to prevent the pump from "choking" when the membrane approaches contact with the surface of the cavity. Such contact could prevent fluid flow from occurring and thereby result in the cavity not fully filling or exhausting. The recessed flow path ensures that flow occurs right down to when the membrane comes into full overall contact with the cavity surface. As an alternative to a single groove, the recessed flow path could be a series of grooves, or lowpoints in a profiled surface (e.g. a ribbed surface, or a roughened surface, or even a surface with projecting pins).

In addition to preventing "choking", the recessed flow paths are believed to contribute to efficient flow of fluid into the cavity, particularly into the cavity from the pressure port.

At each end of the cavity section 13*a* is a port, which opens from the cavity 13 to the outer surface 23 of housing section 11. Port 24 functions as an inflow or inlet port while port 25 functions as an outflow, outlet or exhaust port. Each of inlet ports 24 and exhaust port 25 can, as shown, be made up by a plurality of separate passages 24*a* and 25*a* respectively. A recess 26 is formed in the surface 23 of housing section 11 and into this is engaged a disk of flexible material which forms valve element 27. Likewise, a valve element 28 in the form of a disk of flexible material is provided in the exhaust valve 25 but it locates in a recess 29 in cover 30.

Cover 30 has connecting pieces 31 and 32 (e.g. in the form of annular walls or turrets) which respectively provide connections for an inlet line (not shown) to inlet valve 24 and an outlet or exhaust line (also not shown) from exhaust valve 25.

As mentioned above, the membrane is formed from a non-elastomeric material. Preferably the membrane is formed from a non-elastomeric sheet material, such as a non-elastomeric sheet polymer material. Preferably the membrane material is chemically inert and/or resistant to corrosion by chemicals. The membrane may be formed from a non-elastomeric fluoropolymer. The membrane may be formed from PTFE (polytetrafluoroethylene), PFA (perfluoroalkoxy polymer resin) or FEP (fluorinated ethylene-propylene).

The use of a non-elastomeric fluoropolymer such as PTFE (Teflon) provides a cheap, chemical resistant membrane which will be suitable for almost all uses of the pump. Thus a standard pump can be produced without the need for different membrane materials for different applications.

The membrane is permanently deformed such that the deformed shape of the material conforms to the shape of the opposing surfaces of the pump cavity 13. The membrane will then have a first stable state, in which the membrane lies without further deformation (e.g. extension) against one of the opposing surfaces, and a second stable state, in which the membrane lies without further deformation (e.g. extension) against the other of the opposing surfaces.

Permanent deformation of the membrane may be achieved by forcing the non-elastic membrane against a shaped surface. In one embodiment the Applicant's pump may be assembled. A pressure is then applied to the cavity 13, to force the membrane against one of the cavity's opposing surfaces. This pressure must be sufficiently high to cause the membrane to conform completely to the surface and to permanently deform to this shape, so will generally be significantly greater than an operating pressure of the pump. The pressure can be applied via one or more of the flow ports communicating with the cavity 13. In one embodiment the deformation pressure is around 40 to 50 psi, significantly higher than an operating pressure around 10 to 20 psi.

This method has the advantage that the permanent deformation can be achieved as part of the assembly process. The membrane need be formed only as a section of planar sheet material, with three dimensional permanent deformation occurring in situ after assembly of the pump.

Alternatively, permanent deformation of the membrane may be achieved by forcing the membrane against a shaped surface before fitting the membrane to the rest of the pump. This shaped surface would be shaped such that the resulting permanently deformed membrane conforms to the shape of the opposing surfaces of the pump cavity 13.

The force used in deforming the membrane can be applied by any suitable mechanism. However, pressure is most easily applied by a pressurised fluid, preferably a pressurised gas.

The membrane is non-elastic but still flexible. The membrane may be formed from a sheet material with a thickness in the range 0.002 to 0.025 inches, preferably in the range 0.005 to 0.020 inches, ideally around 0.010 to 0.015 inches. This provides the necessary flexibility to allow the membrane to travel between the two stable states, sufficient stability to cause the membrane to naturally conform to the stable states, allows satisfactory permanent deformation of the membrane as discussed above and provides a durable membrane for long life. Thinner materials tend to lack sufficient stability, while thicker materials are placed under greater stress.

The permanent deformation of the membrane may be plastic deformation. The deformation process may be carried out at low temperature (e.g. room temperature).

Furthermore, the permanent deformation of the membrane can be contrasted with other techniques such as injection moulding, which would result in a membrane which sits naturally in only one of the stable states.

The permanent deformation of the membrane 14 as described above, results in the membrane 14 being bi-stable. One stable position of the membrane 14 is shown in full detail in FIG. 1 while the other stable position is shown in dotted detail. Thus, in the first stable position the membrane 14 is in the cavity section 13*b* and when in the second stable position the membrane 14 is located in the cavity section 13*a*. In effect therefore, the membrane 14 adopts a stable position in either a position which conforms with completion of intake of fluid through inlet valve 24 (i.e. the position shown in the drawings) and a full or completed exhaust position.

A stable position is a position adopted by the membrane in the absence of applied pressure. In the Applicant's pump there are two such positions as described above.

Figure 5:
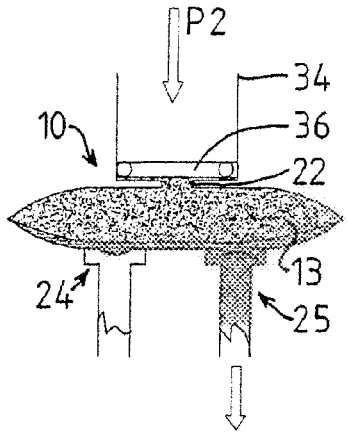
FIG. 5 is a schematic view of the pump on an exhaust cycle.

The membrane 14 is moved between its two stable positions by application of negative P1 and positive P2 pressures applied to the cavity 13*b* through port 22. Consequently with the pump in the configuration shown in FIG. 1 and inlet and outlet conduits or lines attached to connectors 31 and 32 a positive pressure P2 (see FIG. 5) applied through port 22 will force the membrane 14 into an opposite stable position. In this "stroke" of the membrane 14, the inlet valve 24 is forced closed while the outlet valve 25 is forced open and any fluid within the cavity 13 i.e. to that side of the membrane opposite to that which faces port 22, is exhausted through the outlet valve 25.

Figure 6:
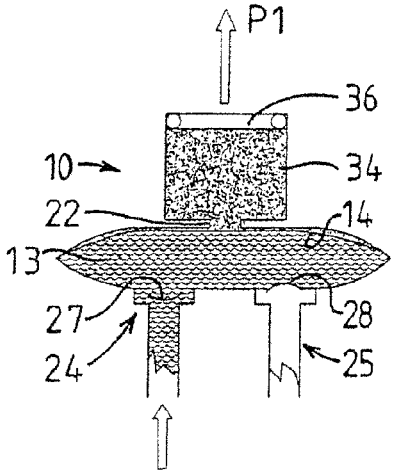
FIG. 6 is a view similar to FIG. 5 but of the inlet cycle.

Upon this "stroke" having been completed a negative pressure P1 applied via port 22 (see FIG. 6) causes the membrane 14 to return to the position shown in FIG. 1 which also causes the exhaust valve 25 to close but the inlet valve 24 to open and enable fluid in the inlet line to be drawn into cavity 13. The cavity 13 thus fills with the fluid ready to be exhausted through the outlet valve 25 upon the next cycle occurring when membrane 14 moves back into cavity section 13*a* under positive pressure P2.

The means for applying negative and positive pressures can take on many forms as will be apparent to the person skilled in the art. The means could comprise, for example, sources of positive and negative pressure, which via suitable valves can be coupled to the port 22.

Figure 7:
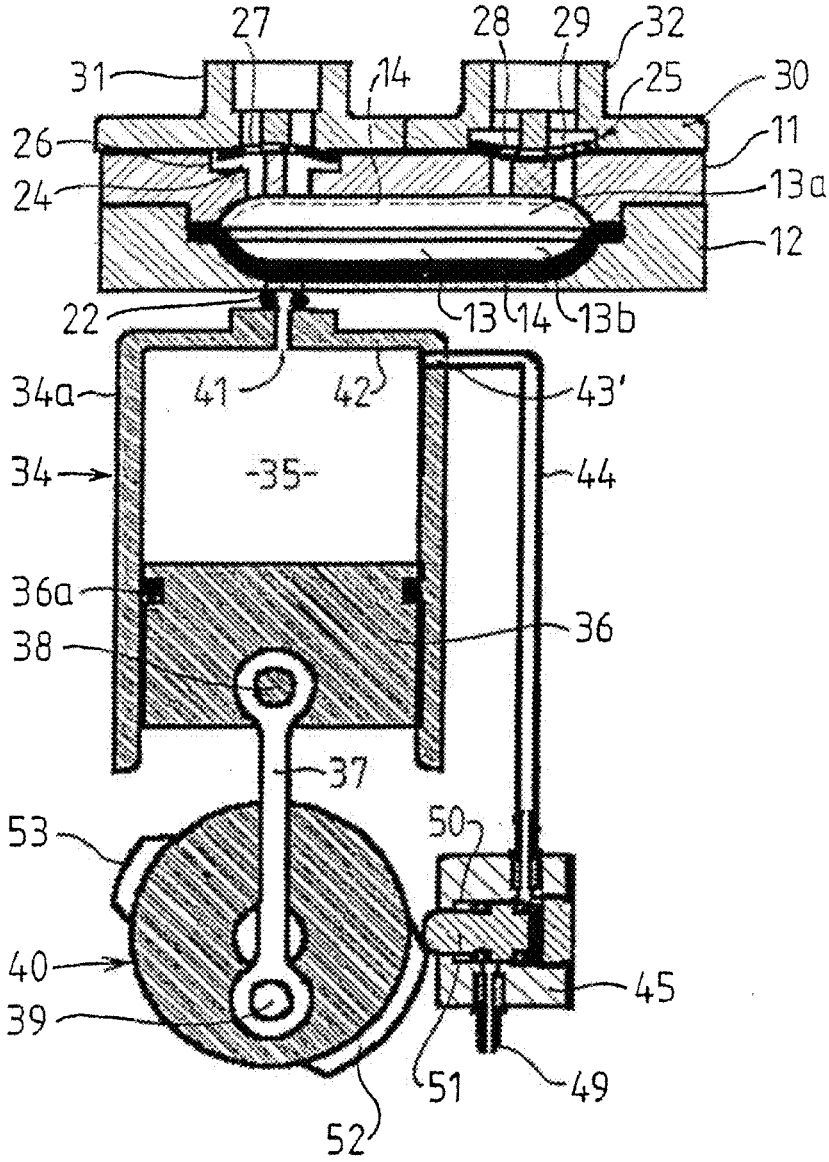
FIG. 7 is a cross-sectional view of a second embodiment which incorporates a different form of control mechanism.

Examples of mechanisms we have developed for applying the positive and negative pressures via port 22 are shown in FIGS. 1 and 7.

As shown in FIG. 1, there is a pneumatic operator 33 that has a body 34 which defines a chamber 35 in which a piston 36 is reciprocally mounted. A piston rod 37 is pivotally connected via pivot 38 to the piston 36. This piston rod 37 is pivotally connected by pivot 39 at its other end to a rotating drive member 40. The drive member 40 is connected to a drive means (not shown) which can be in the form of an electric motor or some other form of motive power.

A port 41 in the end wall 42 of the body 34 is in communication with port 22. As shown in FIG. 1 the body 34 is in close proximity to the pump 10 but it will be appreciated by those skilled in the art that the pneumatic operator 33 could be located quite some distance away from the pump 10 and connected by a conduit extending between ports 22 and 41.

A recess 43 is formed in the inside surface of the side wall 34*a* of body 34. The recess is located adjacent the end of wall 42.

At a position in the length of the side wall 34*a* of the body 34 there is a port 43*a* which opens to atmosphere. As illustrated, the port 43*a* is shown in one preferred position where it is adjacent the inner end of the piston 36 when the piston is at its full stroke away from end wall 42 of body 34. Thus, once the piston has moved past the port 43*a* (i.e. into the position of FIG. 1) the chamber 35 is fully vented to atmosphere. The position of port 43*a* can be varied dependent on use requirements that may require venting before the full stroke of piston 36 has been completed.

Consequently, when the piston 36 advances toward end wall 42 the air in chamber 35 becomes compressed and the resultant positive pressure P2 works on the membrane 14 to force it into cavity section 13*a*. However, when the piston 36 has completed its stroke toward wall 42 the piston sealing ring 36*a* is positioned within the area of the recess 43 whereby air can flow past the sealing ring 36*a* and exhaust through the clearance between the piston 36 and surface of wall 36*a*.

Upon its reverse stroke commencing the piston 36 moves so that sealing ring 36*a* moves away from recess 43 and once again seals against the entire peripheral surface of wall 36*a*. Consequently, the movement of the piston creates negative pressure P1 until the port 43*a* opens to vent the chamber 35 to atmosphere and hence complete the pumping cycle.

An alternative arrangement is shown in FIG. 7.

A port 43' in the wall 34*a* is connected to a conduit 44 which is, in turn, connected to a vent housing 45. One wall of the vent housing 45 has a vent opening 49 which opens into a chamber 50 in which a pin 51 is moveably located. The pin 51 is therefore moveable between the position where conduit 44 is isolated from vent 49 to a position where the vent 49 is connected to conduit 44.

Mounted with a periphery of the driving member 40 and projecting there from is a pair of curved or shaped (e.g. ramped) projections 52 and 53. Consequently, as the rotating member 40 rotates, a projection 52 or 53 comes into contact pin 51 which forces the pin 51 inwardly (relative to the housing) thereby connecting or disconnecting the vent 49 from the conduit 44.

This action causes the chamber 35 to vent to atmosphere (via vent 49) for the period of time that the pin 51 fails to seal closed the conduit 44. In the preferred form of the invention the pin 51 is biased by suitable biasing means (not shown) such as a spring or the like into a position where the vent 49 is closed i.e. isolated from conduit 44.

As a consequence, continued movement of the piston 36 creates a positive pressure build up which via port 22 forces the membrane 14 from the position shown in FIG. 7 to its other stable position in cavity section 13*a*. Material resident in the cavity 13 is thus forced out through the exhaust port 25.

As the piston 36 moves back along the chamber 35 from the second position the vent port 49 will still be closed. This will continue to be the situation until the engagement projection 52 comes into contact with pin 51 to effectively open the vent port 49. As a result, the vent port 49 once again vents the chamber 35 to atmosphere. After the vent 49 is closed from conduit 44 by movement of the pin 51 and as a result of the pin clearing the projection 52, the continued movement of the piston 36 back to its first position will create a negative pressure.

This negative pressure build up will cause the membrane 14 to move back to the position shown in FIG. 7 thereby creating a negative pressure within the chamber 13 which draws pumpable medium on the inlet 24 to be drawn through the inlet valve 24 and into the cavity 13. This inflow will continue until the membrane 14 is fully back into its position shown in FIG. 7.

Preferably the point and the movement of the piston 36 where contact between the pin 51 and projections 53 respectively occurs is adjustable. According to the preferred form of the invention, projections 52 and 53 can be adjustable in position on the periphery of the driving member or rotor 40 so that, for example, the period during which the piston creates a positive pressure could be less. This would result in the time that the membrane is under negative pressure to be greater than the period that it is under positive pressure.

The bi-stable flexible membrane 14 effectively has a small amount of travel between its two states. It is not mechanically connected to any drive thereby giving the membrane free movement in the cavity 13. The cavity shape is round rectangular and its contoured to fit the bi-stable shape of the membrane. Consequently, the cavity supports the diaphragm over its full surface when the diaphragm is in a so-called stable state. The membrane is therefore subject to uniform pressure not only when in the stable states but during the transition between the states as it is supported on both surfaces by the incoming or outgoing pumpable medium and the positive or negative pressure applied across the whole membrane surface via port 22.

It is believed that the bi-stable nature of the membrane, the cavity shape and contour, as well as the uniform pressure to which the membrane is subjected will lead to a significant reduction in mechanical stress on the membrane. This will therefore equate to longer membrane life. Furthermore, during operation of the pump there will be full removal of fluid on the exhaust stroke and full uptake on the inlet stroke as the membrane 14 moves fully from contact and support within the two sections of the chamber.

The pump therefore provides maximum efficiency and good linear flow characteristics, the latter being more critical as viscosity of the pumpable medium increases. The outlet pressure will be governed by the drive pressure therefore no need for pressure limiting. Suction (lift) is governed by the negative pressure. There is thus consistent through put over a wide range of drive pressures.

The valves 24 and 25 are located at the half round extremities of the cavity and in close proximity to the cavity. This proximity of the valves to the cavity thus minimises voids thereby giving optimum dry prime and compression ratio.

The pump arrangement is such that only low inertia needs to be overcome in order to drive the membrane. The valves are progressively closed and finally close before full exhaust or intake. This means that the last thing to occur as the membrane 14 reaches its stable position is movement of the valves into a closed position or opening is the first thing to occur upon the membrane 14 moving from a stable position.

Figure 8:
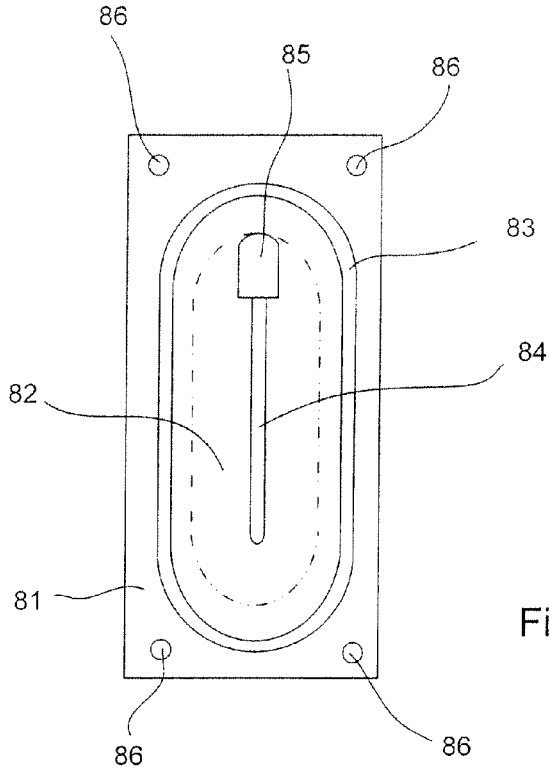
FIG. 8 is a plan view of a first pump body half according to a further embodiment.

FIG. 8 shows the pressure port side of a pump according to a further embodiment. The pump body half 80 includes a generally flat surface 81 with a shallow depression 82 which forms one half of the pump cavity in the assembled pump. The flat surface 81 may have one or more grooves formed therein for receiving one or more O-ring seals to form a sealed connection with the other pump body half 90. The depression 82 preferably is dimensioned and shaped as described above and includes a surface feature 84 defining a recessed flow path communicating with the pressure port 85.

A number of holes 86 may be formed on the flat surface 81 and as will become clear below these aid with correct assembly and alignment of the pump body halves and membrane.

Note that the pressure port 85 is preferably positioned at the top of the chamber, at the same end as the output port. Counter-intuitively, the Applicant has found that the positioning of the pressure port at the same end as the output port actually improves the performance of the pump.

Figure 8A:
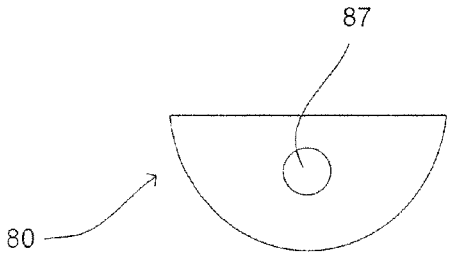
FIG. 8A is an end view of the pump body half of FIG. 8.

FIG. 8A is an end view of the pump body half 80, looking down from the top. This shows that the pump body half is formed essentially as a half cylinder. A connection port 87 communicates with the pressure port 85 to allow connection of a positive/negative pressure source to the pump.

Figure 9A:
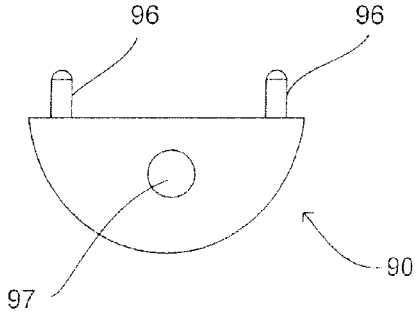
FIG. 9A is an end view of the second pump body half of FIG. 9.
Figure 9:
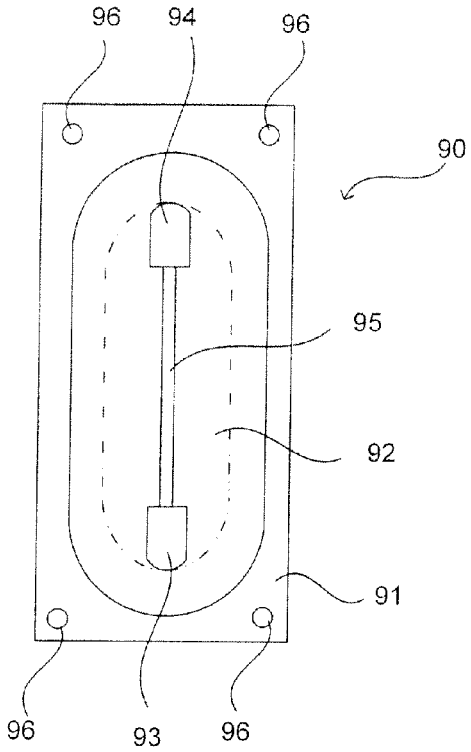
FIG. 9 is a plan view of a second pump body half according to the embodiment of FIG. 8.

FIG. 9 shows the second pump body half 90. This pump body half includes a flat surface 91 which will rest against the flat surface 81 of the first pump body half in an assembled pump. A depression 92 is formed in the flat surface 91 and has a shape matching the shape of the depression 82 in the first pump body half.

An inflow port 93 and an outflow port 94 are formed in the depression, and a recessed flow path is also provided to avoid the "choking" problem described above. Note that the inflow port 93 is preferably positioned at the bottom of the pump chamber, with the outflow port 94 at the top of the chamber. This helps to ensure that air is not trapped within the chamber, since it will naturally flow towards the outflow port and be removed from the chamber as part of the natural operation of the pump.

In contrast, prior pumps suffer from decreased accuracy resulting from trapped air in the chamber. Essentially trapped air occupies space in the pump volume and/or limits movement of the membrane and therefore reduces the pump volume in an uncontrolled and unpredictable manner, resulting in inaccuracy and lowered efficiency. Air may be introduced to the pump during priming, and the Applicant's configuration naturally purges air from the pump.

A number of pins 96 extend from the flat surface 91 and cooperate with the holes 86 to ensure correct alignment of the two pump body halves 80, 90.

FIG. 9A is an end view of the top of the second pump body half 90. An outflow connection port 97 communicates with the outflow port 94 for connection of an outflow conduit to the pump. A similar inflow connection port is provided in the bottom of the second pump body half for connection of an inflow conduit.

Figure 10:
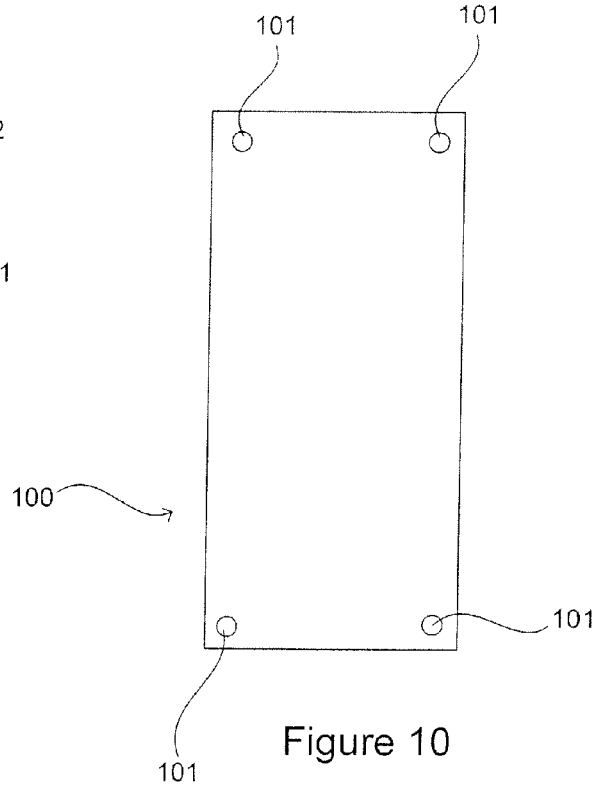
FIG. 10 is a plan view of a membrane for use in the pump of FIGS. 8 to 9A.
Figure 11:
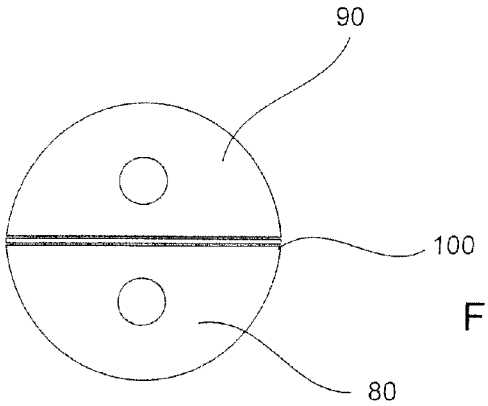
FIG. 11 is an end view showing the assembled pump of FIGS. 8 to 10.

FIG. 10 is a plan view of the membrane 100 used in this embodiment, before permanent deformation of the membrane. The membrane 100 is a flat sheet material with a number of apertures 101 which cooperate with the pins to ensure correct positioning and alignment of the membrane during assembly. The membrane will be permanently deformed as described above to match the inner surfaces of the depressions 82, 92.

One or more sealing elements (e.g. the O-rings described above) create seals between the two flat surfaces 81, 91 and the membrane so as to close the pump chamber.

The pump body halves may be formed from any suitable material. However, preferably a plastics material is used for ease of manufacture. In addition the material should be resistant to the fluid used to apply pressure and the fluid being pumped. Polypropylene may be suitable for many applications.

The pump body halves may be held together by a cover which slides over the assembled cylinder. Alternatively the cover could clamp around the pump halves, or any suitable fasteners could be used.

The embodiment of FIGS. 8 to 11 may otherwise operate in similar manner to the embodiments of FIGS. 1 to 7, with valve arrangements, sources of positive and negative pressure etc as described above.

The improvements and advantages of the Applicant's pump are such that for many applications the membrane need no longer be regarded as a part which will require replacement or maintenance during the life of the pump. This is in complete contrast to prior devices where membranes require regular replacement. This alone represents a significant saving in ongoing operational expenditure. Furthermore, because the membrane is a reliable and long-lived component, complex and costly backup systems for preventing contamination in the event of membrane failure will generally not be required.

The Applicant's pump will continue to deliver reliable, accurate pumping throughout the long life of the pump. The pre-deformation of the membrane, small cavity depth and recessed flow paths all contribute to reliable and complete travel of the membrane from one stable state in contact with one opposing surface of the cavity to the other stable state in contact with the other opposing surface of the cavity. This means that the pump volume is reliably pumped from the inflow port to the outflow port with each and every cycle of the membrane. This accuracy is expected to be retained throughout the long life of the pump, with less than 5% change in accuracy over the life of the device. This is a significant improvement over prior pumps.

Furthermore the design of the Applicant's pump housing and membrane means that only a very low level of power is required to cause motion of the membrane. The membrane is pre-deformed, so that input power is efficiently converted into movement of fluid through the pump, not expended in deformation of the membrane. Once motion of the membrane passes a certain point, the pre-deformed membrane tends to move of its own accord into one of its stable states, which is very efficient (despite the fact that this motion is of course resisted by the fluid being pumped). The small chamber depth also means that the distance travelled by the membrane is small. The Applicant's pump therefore operates at around 95% efficiency, which is around 2 to 2.5 times better than most prior devices. This represents a significant saving in ongoing energy consumption and operating cost. In fact the Applicant's pump can be adequately powered of a small number of conventional 1.5V battery cells and has twice the battery life of some prior pumps.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

The invention claimed is:

1. A membrane pump including:

i. an elongate cavity with opposing surfaces and having a length greater than its width and a ratio of width to depth in the range 10:1 to 16:1, where the depth is measured from one opposing surface to a mid-point of the cavity;

ii. inlet and outlet passages communicating with the cavity;

iii. a pressure port connected to the cavity wherein the pressure port is offset along the length of the cavity; and wherein an exhaust passage is directly connected to the cavity to feed fluid directly from the cavity to the outlet passage, wherein the exhaust passage is formed at the same end of the cavity as the pressure port iv. a pre-deformed non-elastomeric membrane located within the cavity, and substantially coextensive with the cavity;

wherein the pre-deformed non-elastomeric membrane:

a) has a first stable state in contact with one of the opposing surfaces, the first stable state corresponding to completion of an inlet stage of a pumping cycle;

b) has a second stable state in contact with the other opposing surface, the second stable state corresponding to completion of an exhaust stage of the pumping cycle; and c) can be caused to invert from one stable state to the other stable state by application of positive or negative pressure to the cavity via the pressure port.

2. A pump as claimed in claim 1 wherein the ratio of width to depth is in the range 10:1 to 14:1.

3. A pump as claimed in claim 1 wherein the ratio of width to depth is around 12:1.

4. A pump as claimed in claim 1 wherein the non-elastomeric membrane is formed of a non-elastomeric sheet material.

5. A pump as claimed in claim 1 wherein the non-elastomeric membrane is resistant to corrosion by chemicals.

6. A pump as claimed in claim 1 wherein the non-elastomeric membrane is formed from a non-elastomeric fluoropolymer.

7. A pump as claimed in claim 1 wherein the non-elastomeric membrane is formed from one of: polytetrafluoroethylene, perfluoroalkoxy polymer resin or fluorinated ethylene-propylene.

8. A pump as claimed in claim 1 wherein the non-elastomeric member is has a thickness in the range 0.002 to 0.025 inches.

9. A pump as claimed in claim 8 wherein the thickness is in the range 0.005 to 0.020 inches.

10. A pump as claimed in claim 8 wherein the thickness is in the range 0.010 to 0.015 inches.

11. A pump as claimed in claim 1 wherein the depth is less than 5 mm.

12. A pump as claimed in claim 1 wherein the depth is less than 3 mm.

13. A pump as claimed in claim 1 wherein the depth is in the range 1 to 3 mm.

14. A pump as claimed in claim 1 wherein the pressure port is offset along the length of the cavity so as to be adjacent one end of the cavity and wherein the nonelastomeric membrane is substantially coextensive with the cavity.

15. A pump as claimed in claim 14 wherein the outlet passage is situated adjacent the same end of the cavity as the pressure port.

16. A pump as claimed in claim 1 wherein the membrane is clamped between first and second housing sections, each section having a cavity section such that when the housing sections are assembled to form a housing, said cavity is formed.

17. A pump as claimed in claim 15 or 16 wherein each opposing surface has continuous curvature.

18. A method of manufacturing a membrane pump, including:

providing a first pump housing section and a second pump housing section, the first and second pump housing sections being shaped to form, when joined, a cavity with opposing surfaces;

positioning a non-elastomeric sheet material membrane between the first and second pump housing sections;

joining the first and second pump housing sections such that the non-elastomeric membrane extends through the cavity; and permanently deforming the non-elastomeric membrane by applying a pressure to the cavity, thereby forcing the non-elastomeric membrane to conform to one of the opposing surfaces.

19. A pump as claimed in claim 1, wherein the elongate cavity has a length in the range 40 to 70 mm and a width in the range 10 to 20 mm.

20. A pump as claimed in claim 1 wherein recessed flow paths are formed in the opposing surfaces such that fluid can flow along each surface even when the membrane is in contact with that surface.

21. A membrane pump including:

i. an elongate cavity with opposing surfaces and having a length greater than its width and a ratio of width to depth in the range 10:1 to 16:1, where the depth is measured from one opposing surface to a mid-point of the cavity;

ii inlet and outlet passages communicating with the cavity;

iii a pressure port connected to the cavity and offset towards one end thereof, and wherein an exhaust passage is directly connected to the cavity to feed fluid directly from the cavity to the outlet passage wherein the exhaust passage is formed at the same end of the cavity as the pressure port; and iv. a pre-deformed non-elastomeric membrane located within the cavity, and substantially coextensive with the cavity;

wherein the pre-deformed non-elastomeric membrane:

a) has a first stable state in contact with one of the opposing surfaces, the first stable sate corresponding to completion of an inlet stage of a pumping cycle;

b) has a second stable state in contact with the other opposing surface, the second stable state corresponding to completion of an exhaust stage of the pumping cycle; and c) can be caused to invert from one stable state to the other stable state by application of positive or negative pressure to the cavity via the pressure port.

22. The method of claim 18 wherein the non elastomeric sheet material membrane is substantially planar when inserted.

23. The membrane pump of claim 1 where in the pre-deformed non-elastomeric membrane is substantially coextensive with the elongated cavity.

* * * * *

UNITED STATES PATENT AND TRADEMARK OFFICE

CERTIFICATE OF CORRECTION

PATENT NO. : 8,454,324 B2
APPLICATION NO. : 12/582665
DATED : June 4, 2013
INVENTOR(S) : Grapes It is certified that error appears in the above-identified patent and that said Letters Patent is hereby corrected as shown below:

In the Claims

Column 11, Claim 8, line 41, please delete “is has” and insert --has--.

Column 12, Claim 21, line 45, please delete “sate” and insert --state--.

Signed and Sealed this
Twenty-ninth Day of October, 2013

Teresa Stanek Rea
*Deputy Director of the United States Patent and Trademark Office*